US009412342B2

(12) United States Patent
Choi et al.

(10) Patent No.: US 9,412,342 B2
(45) Date of Patent: Aug. 9, 2016

(54) TIMING CONTROLLER, DRIVING METHOD THEREOF, AND LIQUID CRYSTAL DISPLAY USING THE SAME

(71) Applicant: LG Display Co., Ltd., Seoul (KR)

(72) Inventors: Seong Hun Choi, Paju-si (KR); Geon Young Hwang, Gimpo-si (KR); Jin Won Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 34 days.

(21) Appl. No.: 14/102,301

(22) Filed: Dec. 10, 2013

(65) Prior Publication Data

US 2014/0168042 A1 Jun. 19, 2014

(30) Foreign Application Priority Data

Dec. 14, 2012 (KR) ..... 10-2012-0146183

(51) Int. Cl.
*G09G 3/36* (2006.01)
*G09G 5/18* (2006.01)

(52) U.S. Cl.
CPC ..... *G09G 5/18* (2013.01); *G09G 3/3648* (2013.01); *G09G 2370/08* (2013.01)

(58) Field of Classification Search
None
See application file for complete search history.

(56) References Cited

U.S. PATENT DOCUMENTS 8,149,253 B2 * 4/2012 Lee ..... G09G 3/20 345/204
2008/0246752 A1 10/2008 Lee
2009/0251454 A1 10/2009 Jang
2010/0148829 A1 * 6/2010 Hong ..... G09G 3/3648 327/108
2010/0176749 A1 7/2010 Ku
2010/0225620 A1 9/2010 Lee
2010/0289839 A1 * 11/2010 Min et al. ..... 345/691

FOREIGN PATENT DOCUMENTS

CN 101261820 A 9/2008
CN 101273394 A 9/2008
CN 101551968 A 10/2009
CN 101551990 A 10/2009
CN 101751886 A 6/2010
CN 101751891 A 6/2010

OTHER PUBLICATIONS

Office Action for Chinese Patent Application No. CN 201310665283.7, Aug. 5, 2015, 30 Pages.
Second Office Action for Chinese Patent Application No. CN 201310665283.7, Mar. 22, 2016, 29 Pages.

* cited by examiner

*Primary Examiner* — Joseph Haley
*Assistant Examiner* — Ifedayo Iluyomade
(74) *Attorney, Agent, or Firm* — Fenwick & West LLP

(57) ABSTRACT

Disclosed are a timing controller, a driving method thereof, and an LCD device using the same. The timing controller includes a receiver configured to receive a timing signal and input video data, a control signal generator configured to generate a control signal by using the timing signal, a data aligner configured to output image data aligned, and a transferor configured to include a plurality of ports for transferring the aligned image data and the control signal to a plurality of source driving ICs. When number of source driving ICs is greater than number of ports, each of the ports is connected to at least two or more source driving ICs.

13 Claims, 6 Drawing Sheets

TIMING CONTROLLER, DRIVING METHOD THEREOF, AND LIQUID CRYSTAL DISPLAY USING THE SAME

CROSS-REFERENCE TO RELATED APPLICATIONS

This application claims the benefit of the Korean Patent Application No. 10-2012-0146183 filed on Dec. 14, 2012, which is hereby incorporated by reference as if fully set forth herein.

BACKGROUND

1. Field of the Invention

The present invention relates to a liquid crystal display (LCD) device, and more particularly, to a timing controller that communicates with a source driving integrated circuit (IC) in a point-to-point (an embedded clock point-point interface (EPI)) scheme, a driving method thereof, and an LCD device using the same.

2. Discussion of the Related Art

With the advance of various portable electronic devices such as mobile communication terminals, smart phones, tablet computers, notebook computers, etc., the demand for flat panel display (FPD) devices applicable to the portable electronic devices is increasing. Liquid crystal display (LCD) devices, plasma display panels (PDPs), field emission display (FED) devices, organic light emitting display devices, etc. are being actively researched as the FPD devices.

In such FPD devices, the LCD devices are being most widely commercialized at present because the LCD devices are easily manufactured due to the advance of manufacturing technology and realize drivability of a driver and a high-quality image.

LCD devices adjust a light transmittance of liquid crystal with an electric field to display an image. To this end, the LCD devices include a liquid crystal panel in which a plurality of pixels are arranged as a matrix type, and a driving circuit for driving the liquid crystal panel.

FIGS. 1A and 1B are exemplary diagrams illustrating a configuration of a related art LCD device. FIG. 1A illustrates an LCD device having a general bezel structure, and FIG. 1B illustrates an LCD device having a narrow bezel structure.

FIGS. 2A and 2B are exemplary diagrams for describing a related art EPI scheme.

The related art LCD device includes a panel 10 in which a plurality of data lines and a plurality of gate lines are formed to intersect each other, a source driving IC 30 that supplies data voltages to the respective data lines, a gate driving IC (not shown) that supplies a scan signal to the gate lines, and a timing controller 40 that controls the source driving IC and the gate driving IC.

Recently, in addition to a function of LCD devices, a design of the LCD devices is being actively researched.

When purchasing an LCD device, users determine whether to purchase the LCD device in consideration of a design of the LCD device as well as a function of the LCD device.

In terms of a design of LCD devices, narrow bezel technology for decreasing a bezel is being actively researched.

A bezel 12, as illustrated in FIGS. 1A and 1B, denotes an outer portion of a display area 11 displaying an image in the panel 10. A narrow bezel denotes a bezel having a narrow width, and the narrow bezel technology denotes technology for forming the bezel.

The narrow bezel may be implemented by using a non-double rate driving (DRD) scheme instead of a DRD scheme.

The DRD scheme was developed as one scheme for decreasing the number of source driving ICs. By using the DRD scheme, the number of gate lines increases at two times the number of existing gate lines, and the number of data lines is reduced by half. Therefore, despite the number of necessary data driving ICs being reduced by half, the same resolution as the existing resolution is realized.

The DRD scheme may be implemented by using an interface using an EPI scheme.

Generally, examples of a communication scheme between the timing controller 40 and the source driving IC 30 includes a point-to-point scheme which is as illustrated in FIGS. 1A and 2A and a mini-low voltage differential signaling (LVDS) scheme which is as illustrated in FIGS. 1B and 2B.

The point-to-point scheme is referred to as an EPI scheme. The EPI scheme is a scheme in which the timing controller 40 and the source driving IC 30 perform one-to-one communication. Therefore, in the EPI scheme, the number of output ports of the timing controller 40 should be provided in proportion to the number of source driving ICs 30.

In the mini-LVDS scheme, as illustrated in FIG. 2B, a plurality of source driving ICs are connected to the timing controller 40 in parallel. Therefore, in the mini-LVDS scheme, even though the number of source driving ICs 30 increases, the number of output ports of the timing controller 40 does not increase.

The EPI scheme, as described above, was proposed for implementing the DRD scheme, and is better than the mini-LVDS scheme in implementing the DRD scheme.

However, as described above, since the narrow bezel is implemented by using the non-DRD scheme instead of the DRD scheme, the use of the mini-LVDS scheme is more increasing than the EPI scheme suitable for the DRD scheme.

That is, unlike the mini-LVDS scheme, in the EPI scheme, as the number of source driving ICs increases, the number of ports of the timing controller 40 increases in proportion thereto. Therefore, in LCD devices having a high resolution, the mini-LVDS scheme is better than the EPI scheme in realizing the narrow bezel. For example, as illustrated in FIGS. 1A and 1B, a width A of a bezel connected to the source driving IC 30 in panels using the EPI scheme is formed greater than a width B of a bezel connected to the source driving IC 30 in panels using the mini-LVDS scheme.

To provide an additional description, instead of a method of strengthening advantages of the DRD scheme, a method of realizing the narrow bezel is recently attracting much attention, and thus, the use of the EPI scheme suitable for the DRD scheme decreases.

With such a trend, LCD devices using the non-DRD scheme and including eight source driving ICs are being recently developed.

Since the use of the EPI scheme decreases as described above, conventionally developed timing controllers for the EPI scheme are discarded.

That is, the EPI scheme is for the DRD scheme, and a related art LCD device using the EPI scheme may drive a panel by using, for example, only four source driving ICs. However, in order to realize the narrow bezel, by using the non-DRD scheme instead of the EPI scheme, eight source driving ICs are again used.

Therefore, the related art timing controllers, which include only a certain number (four) of ports equal to the number of source driving ICs so as to use the DRD scheme and the EPI scheme, are not applied to the non-DRD scheme and the mini-LVDS scheme which uses eight source driving ICs.

Among two timing controllers applied to LCD devices having the same resolution, the number of ports of a timing controller using the EPI scheme proposed for the DRD scheme corresponds to half of the number of ports of a timing controller using the mini-LVDS applied to the non-DRD scheme. Therefore, the timing controller using the EPI scheme developed for the DRD scheme is not applied to LCD devices which are implemented by using the non-DRD scheme for realizing the narrow bezel, and is discarded.

As described above, the related art timing controller using the mini-LVDS scheme has ports more by two times than a timing controller using the EPI scheme. Therefore, if the related art timing controller using the mini-LVDS scheme is used as-is for realizing the narrow bezel, a size of a printed circuit board (PCB) with the timing controller mounted thereon increases, the manufacturing cost of the timing controller increases due to the increase in the number of ports, and a process of manufacturing the timing controller and a process of mounting the timing controller become complicated.

SUMMARY

Accordingly, the present invention is directed to provide a timing controller, a driving method thereof, and an LCD device using the same that substantially obviate one or more problems due to limitations and disadvantages of the related art.

An aspect of the present invention is directed to provide a timing controller that is connected to one or more source driving ICs through one port, and when two or more source driving ICs are connected to one port, transfers image data to the two or more source driving ICs by using a selection signal, a driving method thereof, and an LCD device using the same.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a timing controller including: a receiver configured to receive a timing signal and input video data from an external system; a control signal generator configured to generate a control signal by using the timing signal; a data aligner configured to align the video data to output image data aligned to be suitable for a panel; and a transferor configured to include a plurality of ports for transferring the aligned image data and the control signal to a plurality of source driving ICs, wherein, when number of the source driving ICs is less than or equal to number of the ports, the ports are respectively connected to the source driving ICs with a one-to-one relationship, and when the number of source driving ICs is greater than the number of ports, each of the ports is connected to at least two or more source driving ICs.

In another aspect of the present invention, there is provided a method of driving a timing controller including: when two or more source driving ICs are connected to one port of the timing controller, generating, by the timing controller, a plurality of selection signals used to identify a plurality of source driving ICs connected to the one port; generating, by the timing controller, a plurality of image data groups to be transferred to the plurality of source driving ICs connected to the one port; and respectively inserting, by the timing controller, the selection signals between the image data groups to output the image data groups and the selection signals through the one port.

In another aspect of the present invention, there is provided an LCD device including: a timing controller; a panel in which a plurality of pixels are respectively formed in a plurality of areas defined by intersections between a plurality of data lines and a plurality of gate lines; a gate driving IC configured to sequentially drive the plurality of gate lines according to control by the timing controller; and a plurality of source driving ICs, two or more of the plurality of source driving ICs being connected to each of a plurality of ports included in the timing controller.

In another aspect of the present invention, there is provided an LCD device including: the timing controller; a panel in which a plurality of pixels are respectively formed in a plurality of areas defined by intersections between a plurality of data lines and a plurality of gate lines; a gate driving IC configured to sequentially drive the plurality of gate lines according to control by the timing controller; and at least one or more source driving ICs connected to each of the ports of the timing controller with a one-to-one relationship.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1A:
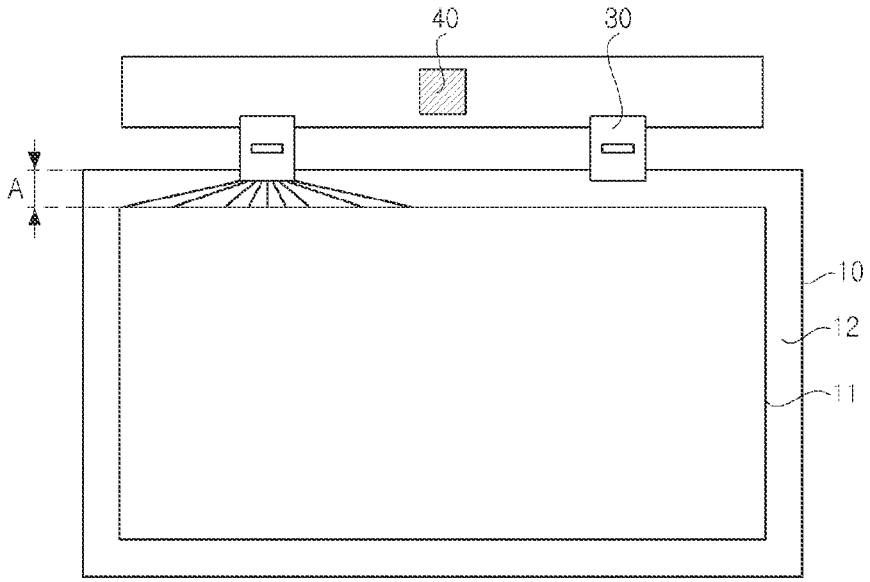
FIG. 1A Related Art
FIGS. 1A and 1B are exemplary diagrams illustrating a configuration of a related art LCD device.
Figure 1B:
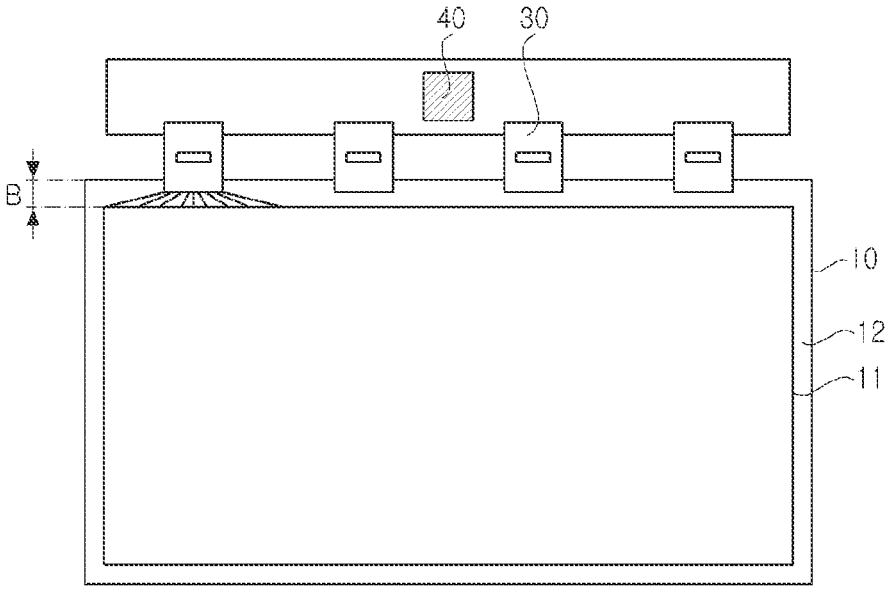
FIG. 1B Related Art
Figure 2A:
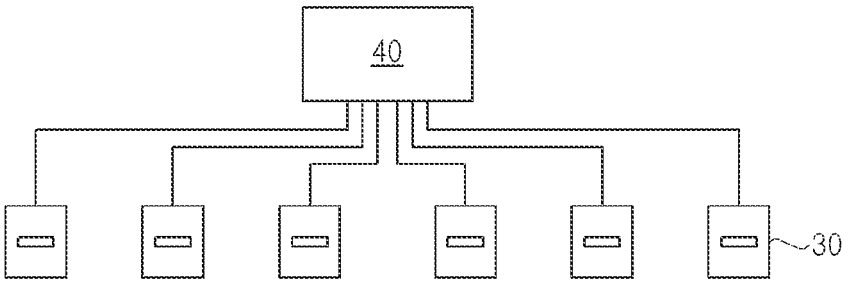
FIG. 2A Related Art
FIGS. 2A and 2B are exemplary diagrams for describing a related art EPI scheme.
Figure 2B:
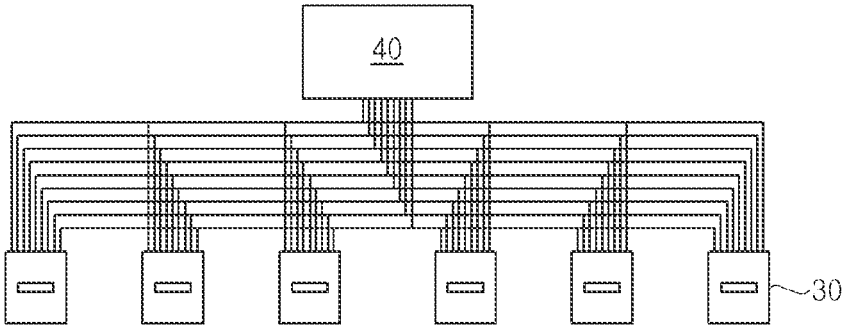
FIG. 2B Related Art
Figure 3:
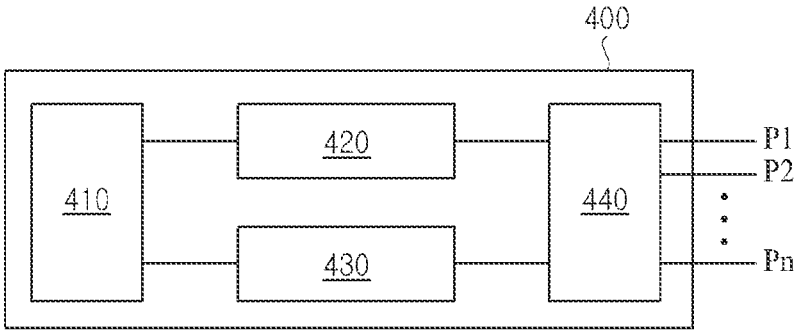
FIG. 3 is an exemplary diagram illustrating a configuration of a timing controller according to the present invention.

FIG. 3 is an exemplary diagram illustrating a configuration of a timing controller according to the present invention.

A timing controller 400 according to the present invention, as illustrated in FIG. 3, includes a receiver 410 that receives a timing signal and input video data from an external system, a control signal generator 420 that generates a control signal by using the timing signal, a data aligner 430 that aligns the video data to output image data aligned to be suitable for a panel, and a transferor 440 that includes a plurality of ports P1 to Pn used to transfer the aligned image data and the control signal to a plurality of source driving ICs.

When the number of source driving ICs is less than or equal to the number (n) of ports, the ports may be respectively connected to the source driving ICs with a one-to-one relationship.

When the number of source driving ICs is greater than the number (n) of ports, each of the ports may be connected to at least two or more source driving ICs.

First, the receiver 410 receives the input video data and the timing signal from the external system, and transfers the input video data to the data aligner 420. The timing signal received through the receiver 410 may be transferred directly from the receiver 410 to the control signal generator 420, or may be transferred to the control signal generator 420 via the data aligner 420.

The control signal generator 420 generates a gate control signal used to control a timing of a gate driver 200 and a data control signal used to control a timing of the data driver 300 by using the timing signal received from the receiver 410.

Especially, when each port is connected to at least two or more source driving ICs, the control signal generator 420 may generate a plurality of selection signals which are respectively inserted between image data groups to be transferred to the respective source driving ICs, so as to identify source driving ICs for receiving the image data groups.

Each of the image data groups denotes a group of image data to be transferred to each of the source driving ICs.

Each of the selection signals denotes a signal used to identify two or more source driving ICs connected to one port.

That is, the control signal generator 420 generates a first selection signal SEL1 which matches a first image data group to be transferred to a first source driving IC. In the same method, the control signal generator 420 generates second to nth selection signals SEL2 to SELn to be respectively transferred to second to nth source driving ICs.

The data aligner 430 aligns the input video data received through the receiver 410 so as to match a size and structure of the panel, and outputs the aligned image data.

Finally, the transferor 440 includes the plurality of ports P1 to Pn used to transfer the aligned image data and the control signal to the plurality of source driving ICs.

When the ports are respectively connected to the source driving ICs with a one-to-one relationship, the transferor 440 outputs image data (transferred from the data aligner 430) to a corresponding source driving IC, connected to a corresponding port, through the corresponding port. That is, when one port is connected to one source driving IC, the transferor 440 outputs only image data, which are intended to be transferred to the one source driving IC connected to the one port, to the one source driving IC through the one port.

When one port is connected to two or more source driving ICs, the transferor 440 outputs image data, which are transferred from the data aligner 430 and are intended to be transferred to the source driving ICs connected to the one port, through the one port. That is, when one port is connected to two source driving ICs, the transferor 440 outputs all image data, which are intended to be transferred to the two source driving ICs connected to the one port, through the one port.

In this case, the transferor 440 respectively inserts a plurality of selection signals, which are transferred from the control signal generator 420, between image data groups to be transferred to the respective source driving ICs, so as to identify source driving ICs for respectively receiving the image data groups, and outputs the image data groups and the selection signals through the port.

That is, when one port is connected to two or more source driving ICs, the control signal generator 420 generates a plurality of selection signals which are intended to be respectively inserted between image data groups to be transferred to the respective source driving ICs, so as to identify source driving ICs for receiving the image data groups, and transfers the selection signals to the transferor 440.

When the selection signals and the image data to be transferred to the source driving ICs connected to one port are received, the transferor 440 selects a first selection signal from among the selection signals to output the first selection signal, and outputs a first image data group to be transferred to a first source driving IC matching the first selection signal. Subsequently, the transferor 440 selects a second selection signal from among the received selection signals to output the second selection signal, and outputs a second image data group to be transferred to a second source driving IC matching the second selection signal. In the same method, the transferor 440 selects one selection signal from among the received selection signals to output the one selection signal, and outputs an image data group to be transferred to a source driving IC matching the selected selection signal.

A driving frequency of the transferor 440 when one port is connected to two or more source driving ICs is set higher by times, corresponding to the number of source driving ICs connected to the one port, than that of the transferor 440 when the plurality of ports are respectively connected to the plurality of source driving ICs with a one-to-one relationship.

For example, when one port is connected to one source driving IC, the transferor 440 is driven at 100 Hz for transferring image data to the one source driving IC, but when one port is connected to two source driving ICs and the transferor 440 outputs the first selection signal, the first image data group, the second selection signal, and the second image data group, the transferor 440 is driven at 200 Hz which is two times of 100 Hz.

In the same method, when one port is connected to three source driving ICs and the transferor 440 outputs the first selection signal, the first image data group, the second selection signal, the second image data group, a third selection signal, and a third image data group, the transferor 440 is driven at 300 Hz which is three times of 100 Hz.

When one source driving IC is connected to one port of the timing controller 400, a driving method of the timing controller 400 is the same as the conventional method.

When two or more source driving ICs are connected to one port of the timing controller 400, a driving method of the timing controller 400 is the same as the conventional method.

First, as described above, when two or more source driving ICs are connected to one port of the timing controller 400, the timing controller 400 generates a plurality of selection signals used to identify the source driving ICs connected to the one port. The selection signals are generated by the control signal generator 420.

Subsequently, the timing controller 400 generates a plurality of image data groups to be respectively transferred to the source driving ICs connected to the one port. The image data groups are generated by the data aligner 430.

The image data group denotes a group of image data to be transferred to one source driving IC. The image data group is the term defined for convenience of description, and a special operation of generating the image data group is not required. That is, among image data generated by the data aligner 430, image data to be transferred to one source driving IC may be defined as one image data group.

Finally, the timing controller 400 respectively inserts the selection signals between the image data groups, and outputs the image data groups and the selection signals through the port.

That is, as described above, in the order of the first selection signal, the first image data group, the second selection signal, the second image data group . . . , an nth selection signal, and an nth image data group, the transferor 440 outputs information about the signals and data through one port.

Figure 4:
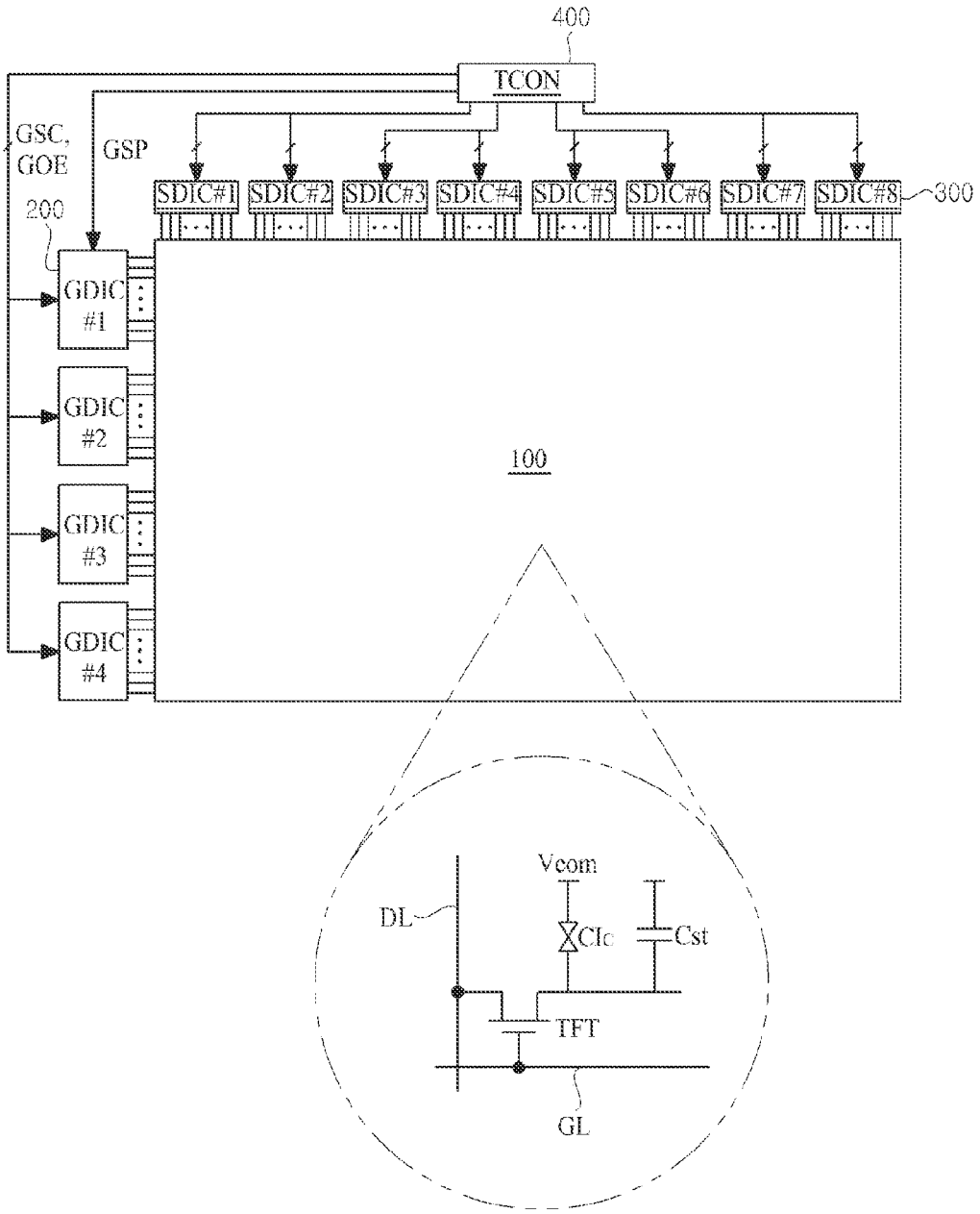
FIG. 4 is an exemplary diagram illustrating a configuration of an LCD device according to the present invention, and is an exemplary diagram illustrating a configuration of an LCD device using an EPI scheme according to the present invention.

FIG. 4 is an exemplary diagram illustrating a configuration of an LCD device according to the present invention, and is an exemplary diagram illustrating a configuration of an LCD device using an EPI scheme according to the present invention.

The LCD device using the EPI scheme according to the present invention, as illustrated in FIG. 4, includes: the timing controller 400 described above with reference to FIG. 3; a panel 100 in which a plurality of pixels are respectively formed in a plurality of areas defined by intersections between a plurality of data lines and a plurality of gate lines; a gate driving IC 200 that sequentially drives the plurality of gate lines according to control by the timing controller 400; and at least one or more source driving ICs 300 that are respectively connected to the ports of the timing controller 400 with a one-to-one relationship.

Figure 5:
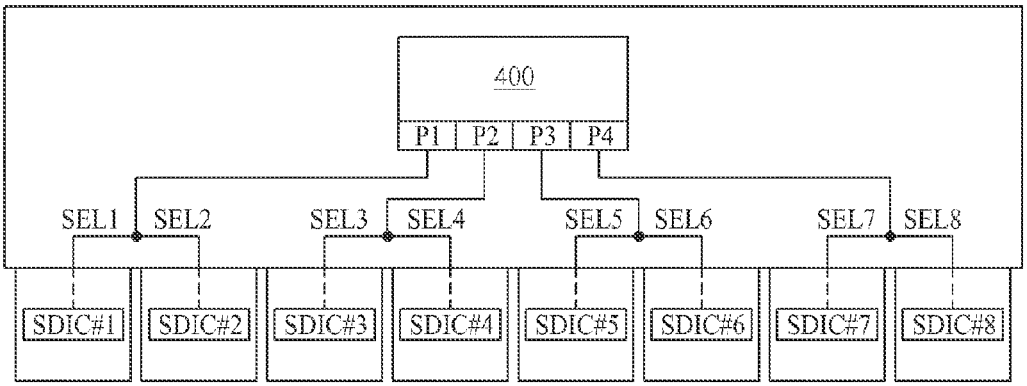
FIG. 5 is an exemplary diagram illustrating a timing controller and source driving ICs applied to an LCD device according to a first embodiment of the present invention.

Particularly, in FIG. 5, an LCD device including eight source driving ICs (SDIC#1 to SDIC#8) 300 and four gate driving ICs (GDIC#1 to GDIC#4) 200 is illustrated as an example of the present invention. Also, in the LCD device of FIG. 5, two source driving ICs 300 are connected to one port of the timing controller 400. The LCD device having such a structure relates to a first embodiment of the present invention, and a detailed description on the first embodiment of the present invention will be made below with reference to FIGS. 5 and 6.

First, the panel 100 includes two glass substrates, and liquid crystal is injected between the two glass substrates. The plurality of pixels are respectively formed at intersection portions of the data lines DL and the gate lines GL, and a thin film transistor (TFT) is formed at each of the pixels. The TFT supplies a data voltage, applied from the source driving IC 300, to a pixel electrode of a corresponding pixel in response to a scan pulse applied from the gate driving IC 200.

The gate driving IC 200 includes a shift register, which sequentially generates the scan pulse in response to a gate start pulse GSP input from the timing controller 400, and a level shifter that shifts a voltage of the scan pulse to a level suitable to drive the liquid crystal. However, when the gate driving IC 200 has a gate-in panel (GIP) type in which the gate driving IC 200 is mounted on the panel 100, the gate driving IC 200 may be driven by gate control signals such as a gate start signal VST and a gate clock GCLK which are generated by the timing controller 400. The gate driving IC 200 may be provided as one or more depending on a size and characteristic of the panel 100, and in FIG. 4, an LCD device including the four gate driving ICs 200 is illustrated as an example.

The timing controller 400, as described above with reference to FIG. 3, includes the receiver 410, the control signal generator 420, the data aligner 430, and the transferor 440, and performs the above-described functions.

In addition to the above-described functions, the timing controller 400 receives external timing signals, such as a vertical sync signal Vsync, a horizontal sync signal Hsync, an external data enable signal DE, and a dot clock CLK, from the external system to generate a control signal used to control an operation timing of the source driving ICs (SDIC#1 to SDIC#8) 300 and a control signal used to control an operation timing of the gate driving ICs (GDIC#1 to GDIC#4) 200.

Since the timing controller 400 is connected to the source driving ICs (SDIC#1 to SDIC#8) 300 in the EPI scheme, the timing controller 400 transfers a clock, an image data packet, and a source control data packet, which includes a preamble signal used to initialize the source driving ICs (SDIC#1 to SDIC#8) 300 and the data control signal, to the source driving ICs (SDIC#1 to SDIC#8) 300 through one data line pair.

The gate control signal GCS generated by the control signal generator 420 of the timing controller 400 includes a gate start pulse GSP, a gate shift clock GSC, and a gate output enable signal GOE.

The data control signal DCS generated by the control signal generator 420 of the timing controller 400 is transferred to the source driving ICs (SDIC#1 to SDIC#8) 300 through a data line pair during a time between a time, for which the preamble signal is transferred, and a time for which the image data packet is transferred. The data control signal DCS includes control data relevant to polarity control and control data relevant to source output.

The control data relevant to polarity control includes control information used to control a pulse type of polarity control signal POL generated in the source driving ICs (SDIC#1 to SDIC#8) 300. The control data relevant to source output includes control information which is used to generate, restore, or control a pulse type of source output enable signal SOE generated in the source driving ICs (SDIC#1 to SDIC#8) 300.

Finally, the source driving ICs (SDIC#1 to SDIC#8) 300 lock an output frequency and a phase according to the preamble signal which is supplied from the timing controller 400 through the data line pair. After the output frequency and the phase are locked, the source driving ICs (SDIC#1 to SDIC#8) 300 restore a serial clock from the image data packet which is input as a digital bitstream through the data line pair. The source driving ICs (SDIC#1 to SDIC#8) 300 output the polarity control signal POL and the source output enable signal SOE by using the source output data packet.

The source driving ICs (SDIC#1 to SDIC#8) 300 restore a clock from the image data packet which is input through the data line pair to generate the serial clock used to sample data, and sample image data which are serially input according to the serial clock.

The source driving ICs (SDIC#1 to SDIC#8) 300 convert sequentially sampled image data into parallel data, convert the image data into positive/negative data voltages, and respectively supply the converted data voltages to the data lines DL in response to the source output enable signal SOE.

Hereinafter, the LCD device having the above-described configuration according to the present invention will be described for each embodiment.

Figure 6:
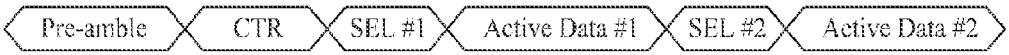
FIG. 6 is an exemplary diagram illustrating a structure of a data packet applied to an LCD device according to a first embodiment of the present invention.

FIG. 5 is an exemplary diagram illustrating a timing controller and source driving ICs applied to an LCD device according to a first embodiment of the present invention, and specifically illustrates only the timing controller 400 and the source driving ICs 300 of the LCD device of FIG. 4. FIG. 6 is an exemplary diagram illustrating a structure of a data packet applied to an LCD device according to a first embodiment of the present invention.

The LCD device according to the first embodiment of the present invention, as illustrated in FIG. 5, includes: the timing controller 400; the panel 100 in which the plurality of pixels are respectively formed in the plurality of areas defined by intersections between the plurality of data lines and the plurality of gate lines; the gate driving IC 200 that sequentially drives the plurality of gate lines according to control by the timing controller 400; and the source driving ICs 300 that are each connected to at least two or more ports of the timing controller 400. That is, in the LCD device according to the first embodiment of the present invention, as illustrated in FIG. 5, two or more source driving ICs 300 are connected to each of the ports configuring the transferor 440 of the timing controller 400.

A configuration and function of each of the panel 100, the gate driving IC 200, the source driving IC 300, and the timing controller 400 are the same as those of the panel 100, the gate driving IC 200, the source driving IC 300, and the timing controller 400 which have been described above with reference to FIGS. 3 and 4, and thus, their detailed description is not provided. The following description will focus on the function of the timing controller 400.

The timing controller 400 performs the functions described above with reference to FIGS. 3 and 4.

That is, one source driving IC 300 may be connected to each port of the timing controller 400, or two or more source driving ICs 300 may be connected to each port of the timing controller 400. In the first embodiment of the present invention, two or more source driving ICs 300 may be connected to one port.

According to the first embodiment of the present invention, in the LCD device of FIG. 5, eight source driving ICs 300 are provided, but the number of source driving ICs 300 may be variously set.

However, the following description will be made on the LCD device including eight source driving ICs 300 according to the first embodiment of the present invention, for comparing with an LCD device according to a second embodiment of the present invention illustrated in FIG. 7.

Figure 7:
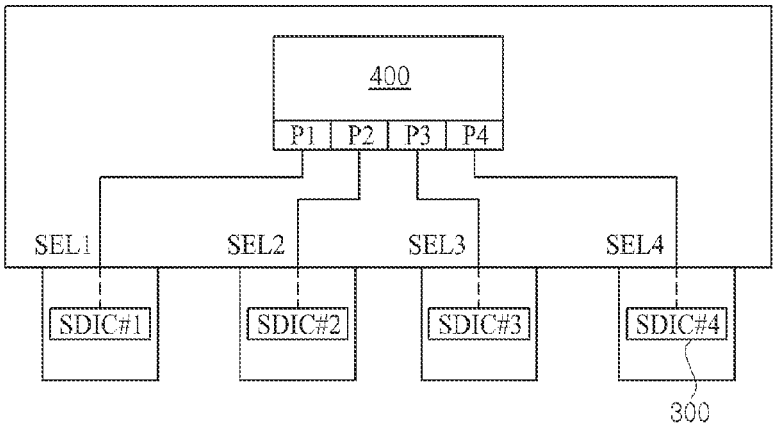
FIG. 7 is an exemplary diagram illustrating a timing controller and a source driving IC applied to an LCD device according to a second embodiment of the present invention.

That is, the transferor 440 of the timing controller 400 of FIG. 7 includes four ports P1 to P4, each of which is connected to two source driving ICs.

A first port P1 is connected to a first source driving IC (SDIC#1) and a second source driving IC (SDIC#2). A second port P2 is connected to a third source driving IC (SDIC#3) and a fourth source driving IC (SDIC#4). A third port P3 is connected to a fifth source driving IC (SDIC#5) and a sixth source driving IC (SDIC#6). A fourth port P4 is connected to a seventh source driving IC (SDIC#7) and an eighth source driving IC (SDIC#8).

The timing controller 400, as illustrated in FIG. 6, respectively inserts the plurality of selection signals, which are transferred from the control signal generator 420, between image data groups to be transferred to the respective source driving ICs, so as to identify source driving ICs for respectively receiving the image data groups, and outputs the image data groups and the selection signals through the respective ports.

That is, the preamble signal, various control signals (CTR), a first selection signal (SEL#1), a first image data group (Active Data#1), a second selection signal (SEL#2), and a second image data group (Active Data#2) are sequentially output through the first port P1. Here, the control signal may be the data control signal DCS.

In the same method, the preamble signal, the various control signals (CTR), a third selection signal (SEL#3), a third image data group (Active Data#3), a fourth selection signal (SEL#4), and a fourth image data group (Active Data#4) are sequentially output through the second port P2. The preamble signal, the various control signals (CTR), a fifth selection signal (SEL#5), a fifth image data group (Active Data#5), a sixth selection signal (SEL#6), and a sixth image data group (Active Data#6) are sequentially output through the third port P3. The preamble signal, the various control signals (CTR), a seventh selection signal (SEL#7), a seventh image data group (Active Data#7), an eighth selection signal (SEL#8), and an eighth image data group (Active Data#8) are sequentially output through the fourth port P4.

FIG. 7 is an exemplary diagram illustrating a timing controller and a source driving IC applied to an LCD device according to a second embodiment of the present invention, and specifically illustrates only the timing controller 400 and the source driving ICs 300 of the LCD device of FIG. 4.

The LCD device according to the second embodiment of the present invention, as illustrated in FIG. 7, includes: the timing controller 400; the panel 100 in which the plurality of pixels are respectively formed in the plurality of areas defined by intersections between the plurality of data lines and the plurality of gate lines; the gate driving IC 200 that sequentially drives the plurality of gate lines according to control by the timing controller 400; and at least one or more source driving ICs 300 that are connected to each of the ports of the timing controller 400 with a one-to-one relationship.

A configuration and function of each of the panel 100, the gate driving IC 200, the source driving IC 300, and the timing controller 400 are the same as those of the panel 100, the gate driving IC 200, the source driving IC 300, and the timing controller 400 which have been described above with reference to FIGS. 3 and 4, and thus, their detailed description is not provided.

A difference between the LCD device according to the second embodiment of the present invention and the LCD device according to the first embodiment of the present invention is that each of the four ports P1 to P4 configuring the transferor 440 of the timing controller 400 is connected to only one source driving IC 300.

In this case, the LCD device according to the second embodiment of the present invention is configured and driven in the same scheme as the EPI scheme.

That is, the timing controller 400 outputs image data, which are intended to be transferred to a source driving IC connected to a corresponding port, through the corresponding port by using the EPI scheme.

However, the timing controller 400 applied to the LCD device according to the second embodiment of the present invention may use the timing controller 400 applied to the LCD device according to the first embodiment of the present invention as-is.

That is, the timing controller 400 according to the embodiment may be included in the LCD device of FIG. 5, and may be driven by the non-DRD scheme. Alternatively, the timing controller 400 according to the embodiment may be included in the LCD device of FIG. 7, and may be driven by the DRD scheme.

To provide an additional description, the timing controller 400 according to the embodiment may be applied in common to the LCD device using the non-DRD scheme and the LCD device using the DRD scheme.

In this case, a driving frequency of the timing controller 400 in which two or more source driving ICs 300 are connected to one port as illustrated in FIG. 5 is set higher by times, corresponding to the number of source driving ICs connected to one port, than that of the timing controller 400 in which one port is connected to one source driving IC 300 with the one-to-one relationship as illustrated in FIG. 7.

According to the present invention, a timing controller using the EPI scheme developed for the DRD scheme can be applied as-is to LCD devices using the mini-LVDS scheme. That is, the timing controller using the EPI scheme developed for the DRD scheme can be applied in common to LCD devices using the DRD scheme and LCD devices using the non-DRD scheme.

Moreover, according to the present invention, since the number of ports of the timing controller according to the present invention is less than the number of ports of the related art timing controller, a size of a PCB can decrease, the manufacturing cost of the timing controller can decrease due to the decrease in the number of ports, and a process of manufacturing the timing controller and a process of mounting the timing controller can become complicated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A timing controller comprising:

a receiver circuit configured to receive a timing signal and input video data from an external system;

a control signal generator circuit configured to generate a control signal by using the timing signal;

a data aligner circuit configured to align the video data to output image data aligned to be suitable for a panel; and a transferor circuit comprising a plurality of ports configured to transfer the aligned image data and the control signal to a plurality of source driving ICs, wherein each of the plurality of ports is connected to two or more source driving ICs via a data line, the transferor circuit configured to generate an output signal at each of the plurality of ports transmitted over the data line, the output signal comprising groups of image data, selection signals associated with the groups of image data and a clock signal, each of the selection signal identifying one of the source driving ICs to receive the image data groups.

2. The timing controller of claim 1, wherein the transferor circuit is configured to:

output image data through the one port when one port is connected to two or more source driving ICs, the image data received from the data aligner circuit for transmitting to the source driving ICs connected to the one port.

3. The timing controller of claim 2, wherein the transferor circuit is configured to insert a plurality of selection signals between the image data groups when at least one of the plurality of ports is connected to two or more source driving ICs.

4. The timing controller of claim 1, wherein a driving frequency of the transferor circuit when one port is connected to two or more source driving ICs is set higher by a number of time than a driving frequency of the transferor circuit when the plurality of ports are respectively connected to the plurality of source driving ICs with the one-to-one relationship, wherein the number corresponds to a number of the source driving ICs connected to the one port.

5. A method of driving a timing controller, the method comprising:

generating, by the timing controller, a plurality of selection signals transmitted via a data line to identify a plurality of source driving integrated circuits (ICs) connected to one port when two or more source driving ICs are connected to the port of the timing controller; generating, by the timing controller, a plurality of image data groups to be transferred to the plurality of source driving ICs from the port to the two or more source driving ICs over via the data line; generating, by the timing controller, a clock signal for sending to the plurality of source driving ICs connected to the port via the data line; and inserting, by the timing controller, the selection signals between the image data groups, respectively, to output the image data group, clock signal and the selection signals through the port and the data line.

6. A liquid crystal display (LCD) device comprising:

a timing controller configured to output a clock signal, image data groups and selection signals through a plurality of ports, the selection signal identifying a source driving integrated circuit (IC) to receive an image data group;

a panel having a plurality of pixels respectively formed in a plurality of areas defined by intersections between a plurality of data lines and a plurality of gate lines;

a gate driving IC configured to sequentially drive the plurality of gate lines according to control by the timing controller; and a plurality of source driving ICs, two or more of the plurality of source driving ICs connected to each of the plurality of ports of the timing controller via a data line to receive the clock signal, the image data groups and the selection signals.

7. The LCD device of claim 6, wherein a driving frequency of the timing controller is set higher by a number of times than a driving frequency of the timing controller when the plurality of ports are respectively connected to the plurality of source driving ICs with a one-to-one relationship, the number corresponding to a number of the source driving ICs connected to the one port.

8. A liquid crystal display (LCD) device comprising:

a timing controller comprising:

a receiver circuit configured to receive a timing signal and input video data from an external system, a control signal generator circuit configured to generate a control signal by using the timing signal, a data aligner circuit configured to align the video data to output image data aligned to be suitable for a panel, and a transferor circuit comprising a plurality of ports configured to transfer the aligned image data and the control signal to a plurality of source driving integrated circuits (ICs), wherein each of the plurality of ports is connected to two or more source driving ICs via a data line, the transferor circuit configured to generate an output signal at each of the plurality of ports transmitted via the data line, the output signal comprising groups of image data, selection signals associated with the groups of image data and a clock signal, each of the selection signal identifying one of the source driving ICs to receive the image data groups, wherein each of the ports is connected to at least two or more source driving ICs when the number of source driving ICs is greater than the number of ports; and a panel having a plurality of pixels are respectively formed in a plurality of areas defined by intersections between a plurality of data lines and a plurality of gate lines;

a gate driving IC configured to sequentially drive the plurality of gate lines according to control by the timing controller; and at least two or more source driving ICs connected to each of the ports of the timing controller via the data line.

9. The LCD device of claim 8, wherein the timing controller outputs, through a corresponding port, image data for transmitting to a source driving IC connected to the corresponding port.

10. The timing controller of claim 1, wherein the clock signal is embedded across at least the groups of image data and the selection signals.

11. The method of claim 5, wherein the clock signal is embedded across at least the groups of image data and the selection signals.

12. The LCD device of claim 6, wherein the clock signal is embedded across at least the groups of image data and the selection signals.

13. The LCE device of claim 8, wherein the clock signal is embedded across at least the groups of image data and the selection signals.

* * * * *